US006749722B2

(12) United States Patent
Malmström et al.

(10) Patent No.: US 6,749,722 B2
(45) Date of Patent: Jun. 15, 2004

(54) METHOD OF MAKING SIZED PAPER, A SIZED PAPER GRADE, AND A PAPER SIZE

(75) Inventors: Olof Malmström, Turku (FI); Markku Nurminen, Raisio (FI); Raija Savolainen, Raisio (FI); Ari Teijo, Riihikoski (FI); Claes Zetter, Turku (FI)

(73) Assignee: Raisio Chemicals Ltd., Raisio (FI)

( * ) Notice: Subject to any disclaimer, the term of this patent is extended or adjusted under 35 U.S.C. 154(b) by 0 days.

(21) Appl. No.: 09/895,160

(22) Filed: Jul. 2, 2001

(65) Prior Publication Data

US 2001/0054491 A1 Dec. 27, 2001

Related U.S. Application Data

(63) Continuation-in-part of application No. 09/380,752, filed as application No. PCT/FI98/00212 on Mar. 11, 1998, now abandoned.

(30) Foreign Application Priority Data

Mar. 14, 1997 (FI) ..... 971084

(51) Int. Cl.[7] ..... D21H 23/00

(52) U.S. Cl. ..... 162/179; 162/181.2; 162/158; 162/164.1; 162/175; 106/162.1; 106/207.1

(58) Field of Search ..... 162/179, 181.2, 162/158, 164.1, 175; 106/162.1, 207.1, 217.9

(56) References Cited

U.S. PATENT DOCUMENTS 5,766,417 A * 6/1998 Brungardt ..... 162/158
5,846,663 A * 12/1998 Brungardt et al. ..... 428/537.5

* cited by examiner

*Primary Examiner*—Peter Chin
*Assistant Examiner*—Mark Halpern

(57) ABSTRACT

The present invention relates to a method of manufacturing a paper of multi-color ink-jet printable grade. A proper hydrophicity for the paper is secured by using an 2-oxetanone size in the appropriate sizing steps. The size is made from non-branched and branched-chain fatty acids having main chain comprising 6–22 carbons linked with each other by saturated bonds.

29 Claims, No Drawings

METHOD OF MAKING SIZED PAPER, A SIZED PAPER GRADE, AND A PAPER SIZE

CROSS-REFERENCE TO RELATED APPLICATIONS

This application is a continuation-in-part of copending U.S. patent application Ser. No. 09/380,752 filed Sep. 13, 1999, now abandoned, which is the U.S. national phase filing of International Patent Application No. PCT/FI98/00212 filed Mar. 11, 1998, which claims priority from Finland Patent Application No. 971084 filed Mar. 14, 1997.

The present invention relates to a method for producing a paper grade in which hydrophobizing paper sizes are used. These sizes have a reactive functional group capable of forming covalent bonds with cellulose fiber and such hydrophobic tails thereof that are directed outward from said fiber.

The present invention relates also to a method for producing a paper grade having additives in its furnish, in which method alkaline hydrophobizing paper sizes are used. Most fine paper grades are manufactured under alkaline conditions because of the facility of using precipitated calcium carbonate (PCC) as a filler. Said filler gives an increased durability against ageing, and better brightness. The water circulation of a papers machine has also been possible to close more complete.

Current printing applications of fine paper grades set a particular weight on sizing, examples of the latter being non-impact printing (NIP) and, particularly, ink-jet printing. Conventional office paper grades have not been able to meet the requirements set for so-called "multi-printable, or multi-purpose" office paper, i.e. suitable for use in varying types of copiers and printers including ink-jet printers.

According to experiences gathered from the results of ink-jet printing, printing quality is affected by the fiber composition, and thereby chiefly by the ratio of coniferous to deciduous wood. As to the quality of finished paper, the structure and topography of pores in the finished sheet are crucial to the outcome of the printing process in the discussed method. In terms of paper qualities, the printing result is determined by the noncompressible grain of the sheet and other parameters characterizing the ink absorption capability of the sheet. A paper grade optimized for ink-jet printing is required to have a sufficient capability of adsorbing the printing ink, yet permitting the ink to dry at a sufficiently fast rate before the ink can spread along the fibers or into the pores of the sheet structure. Thence, the surface-chemical interactions of the sheet with the ink are accentuated in ink-jet printing.

In addition to the basic factors related to the paper structure, the quality of ink-jet printing can be modified by means of additives used in papermaking such as hydrophobizing internal sizes and surface size formulations, surface size starches and pigments of high surface area.

Formulations for paper sizing have been developed in the art with the aim of modifying the surface-chemical properties of the paper and improving the black-and-white monochrome printing quality by virtue of increasing the hydrophobicity of the paper. By elevating the hydrophobicity of the paper, it has been possible to achieve a better printing result of black ink on the sheet through improved control of ink absorption under capillary forces into the sheet structure in both the lateral and the depth directions of the sheet. This approach has resulted in a sharply defined printing pattern and elimination of black ink spread (wicking) on the sheet.

The most commonly used sizing formulations suitable for fine paper, especially manufactured under alkaline conditions, are based on alkenylsuccinic acid anhydrides (ASA) and alkyl-ketene dimers (AKD). Both of these size types have a reactive functional group capable of forming a covalent bond with the cellulose fiber, as well as hydrophobic tails directed away from the fiber. The character and orientation of these hydrophobic tails make the fiber water-repellent. AKD and ASA sizes are dosed as an emulsion into the wet end of the paper machine and the sizing power is developed in the dryer section and the machine roll.

Commercial-grade alkylketene dimer sizes containing one β-lactone ring are made by dimerization from two saturated straight-chain fatty acid chlorides; the most commonly used alkylketene dimer sizes being made from palmitic and/or stearic acid. Alkenyl succinic acid anhydrides, or ASA compounds, are obtained as the reaction products of long-chain olefins ($C_{15}$–$C_{20}$) with maleic acid anhydride.

With the goal of higher hydrophobicity of the paper in internal sizing of paper it has been necessary to use a higher dosing rate of ASA and AKD sizes in the paper machine, whereby the runnability of the machine has been deteriorated and different types of contamination problems in the process increased.

The approach of using a higher degree of hydrophobicity for controlling the printing behaviour of black ink does not, unfortunately, give an optimal result in multi-color printing. In fact, this method has been able to improve ink hold-out, with improved density as a result. In multi-color printing the application rates of inks are however higher than in black printing, which, together with the higher absorption has frequently caused a nuisance of insufficiently slow drying of printed color inks, resulting the spreading and mixing of superimposed colors on the printed sheet (known as color bleeding).

Consequently, different attempts have been made to improve the quality of multi-color ink-jet printing for instance by varying the amount of the size used in the internal sizing of the paper, and using fillers having higher surface-area, in order to control the behaviour of the printing colors. Surface sizing is also one possibility to affect the printability of paper.

Although different approaches have been proposed for the improvement of sheet absorption capability and a balanced degree of sufficient hydrophobicity for ink-jet printing, the field is still looking for alternative methods of manufacturing paper grades optimized for multicolor ink-jet printing.

Consequently, the main aspect of the invention is to provide a method of manufacturing paper of mono- and multi-color ink-jet printable grade by de-watering a paper web from fiber pulp slurry, the method containing a step of adding a 2-oxetanone based size to the pulp slurry, the size being manufactured from greater number than one of fatty acids having a main chain comprising 6 to 22 carbons linked to each other by saturated bonds, and of which acids at least one is an acid with branched chain.

A further aspect of the invention is to provide a method of manufacturing a paper of mono- and multi-color ink-jet printable grade from fiber pulp slurry into a paper web, the method containing a step of adding a size onto the paper web, wherein the size is a 2-oxetanone based size manufactured from greater number than one of fatty acids, the acids having a main chain comprising 6 to 22 carbons linked to each other by saturated bonds, and of which acids at least one is an acid with branched chain.

A still another aspect of the invention is to provide a method of manufacturing a paper of mono- and multi-color ink-jet printable grade by de-watering a paper web from fiber pulp slurry, the method containing a step of adding a 2-oxetanone size to the pulp slurry, in which size the fatty acid base consists of a greater number than one of fatty acids having a main chain comprising 6 to 22 carbons, the main chains of the acids dominantly being of thoroughly saturated type, but including in at least one of the acids a branching.

The use of sizes based on 2-oxetanone has been known for a long time in papermaking (e.g., refer to U.S. Pat. No. 2,627,477, and J. W. Davis, et. al.: A new sizing agent for paper—alkylketene dimers, Tappi 1956, Vol. 39, No. 1, but this litterature does not mention the use of 2-oxetanone produced from saturated fatty acids, of which at least one posses a branched carbon chain.

Analogously to conventional AKD sizes, the sizes used in the methods of the invention may be made starting from fatty acids, whereby it is essential that at last one of the fatty acids have a branched carbon chain, which chains, however, contains no double bonds. The length of the carbon chain in the starting material fatty acids may vary in the range from 6 to 22 carbons.

It has been found according to one aspect of the invention that particularly a mixture of branched-chain and linear-chain (e.g., with a ratio of 40/60 to 60/40) gives optimal qualities for a paper grade intended for ink-jet printing, especially balanced qualities as well as for mono- and multi-color printing. The paper has proven to serve also as a "multi-purpose" office paper (suitable for printing machines of another type).

In terms of papermaking, herein it must be pointed out that the amounts of size required in the novel method for attaining a desirable end result will be smaller than those needed in conjunction with conventional size formulations, thus alleviating the contamination and dirt adherence problems caused by sizes in the paper machine.

The invention also relates to a paper grade manufactured by treating with a size formulation based on 2-oxetanone manufactured from fatty acids of which at least one posses a branched carbon chain. The paper may contain mineral fillers, such as calcium carbonate, especially precipitated calcium carbonate (PCC), and alum.

Stable emulsions of the novel sizes can be made in the same manner as standard AKD emulsions.

The paper grade according to the present invention is generally sized so that at least 200 g, advantageously at least 600 g, and most advantageously at least 1 kg of size is added per ton of paper.

The paper grade according to the invention achieves a balanced compromise in the adsorption and hydrophobicity qualities of the paper so that a high-quality printing result is achieved with both black and color inks (that is, the benefits include minimal show-through, high printing density, no wicking, no bleeding, and minimal raggedness of the printed contours when printing with a black ink or color on color. Moreover, such a balanced printing result is achievable by virtue of the paper grade according to the invention without resorting to coating of the sheet, improvement of hydrophobicity by surface treatment or using a higher amount of surface size starch above normal addition rates.

Furthermore, the size formulations according to the invention make it possible to attain a desirable end result in ink-jet printing with a smaller amount of size dosing than is that required with conventional AKD sizes, whereby the problems of paper machine contamination and adherence of dirt and fuzz to rolls plaguing conventional AKD sizes can be avoided.

One type of size formulation according to the present invention is a 2-oxetanone size made starting from isostearic acid or a mixture of fatty acids advantageously containing at least 40% of isostearic acid or some other fatty acid with a branched carbon chain.

EXAMPLE 1

For the evaluation of the method, test sheets of 80 g/m$^2$ basis weight were first made according to standardized SCAN test methods using a circulating water sheet mould, a wet press and a drying cylinder. The pulp slurry was prepared using birch/pine pulp in the ratio of 60/40, internal size starch Raisamyl 135 ESP (by Raisio Chemicals Oy) by 0.3% of fiber weight, PCC filler by 22% of sheet weight and retention agents by a 0.16% overall amount of fiber weight. The internal sizes were dosed into the pulp slurry by 0.06, 0.12 and 0.20% of fiber weight.

The ready-made test sheets were tested in the Cobb$_{60}$ water absorption test and the Schroder ink penetration test immediately after drying, the next day prior to curing and after drying and curing. The curing was performed by keeping the test sheets for 10 min at 105° C. in a heat chamber.

The comparative size formulation in the example was a conventional AKD size (Raisafob 5105). The isostearic-acid-based AKD size was dispersed in the same fashion as the conventional AKD size using cationic starch.

TABLE 1

| | Cobb$_{60}$ test [g/m$^2$] | | | Schröder test [s] | | |
|---|---|---|---|---|---|---|
| Size composition/dosing [%] | immediately | next day, no curing | curing (10 min, 105° C.) | immediately | next day, no curing | curing (10 min, 105° C.) |
| palmitic/stearic acid ratio 60/40 | | | | | | |
| 0.06 | 65 | 37 | 34.1 | 5 | 25 | 27 |
| 0.12 | 18.7 | 15.9 | 16.3 | >1000 | >1000 | >1000 |
| 0.20 | 15.0 | 14.0 | 13.9 | >1000 | >1000 | >1000 |
| palmitic/stearic acid ratio 40/60 | | | | | | |
| 0.06 | 29.8 | 23.1 | 26.1 | 47 | 70 | 112 |
| 0.12 | 17.3 | 16.0 | 15.6 | >1000 | >1000 | >1000 |
| 0.20 | 16.3 | 12.8 | 14.6 | >1000 | >1000 | >1000 |

TABLE 1-continued

| Size composition/dosing [%] | Cobb$_{60}$ test [g/m$^2$] immediately | next day, no curing | curing (10 min, 105° C.) | Schröder test [s] immediately | next day, no curing | curing (10 min, 105° C.) |
|---|---|---|---|---|---|---|
| isostearic-acid-based AKD size, 100 % branched chains | | | | | | |
| 0.06 | thru | thru | thru | 0 | 0 | 0 |
| 0.12 | 70.0 | 55.0 | 52.3 | 0 | 0 | 2 |
| 0.20 | 45.6 | 33.4 | 32.3 | 10 | 22 | 25 |
| isostearic-acid-based AKD size, 50/50 branched/unbranched chains | | | | | | |
| 0.06 | thru | thru | thru | 0 | 0 | 0 |
| 0.12 | 22.8 | 24.7 | 19.8 | 165 | 137 | 217 |
| 0.20 | 17.3 | 16.2 | 15.7 | 775 | >1000 | >1000 |
| AKD size, 40/60 branched/unbranched | | | | | | |
| 0.06 | 75 | 40.2 | 37.8 | 20 | 35 | 80 |
| 0.12 | 43.7 | 21.6 | 20.2 | 320 | 348 | 450 |
| 0.2 | 28.9 | 15.7 | 14.7 | >1000 | >1000 | >1000 |
| AKD size, 40/60 branched/unbranched | | | | | | |
| 0.06 | thru | thru | thru | 0 | 0 | 0 |
| 0.12 | 53 | 25.3 | 23.2 | 100 | 120 | 190 |
| 0.2 | 32.3 | 18.4 | 16.2 | 700 | >1000 | >1000 |

As is evident from the results given in Table 1, the isostearic-acid-based AKD size (with a ratio of 40/60 to 60/40 of branched/non-branched carbon chains) achieves a sizing quality comparable with that available by conventional sizes based on a mixture of palmitic/stearic acids.

EXAMPLE 2

Different types of AKD sizes were also evaluated in a pilot-scale paper machine running 60 m/min (4.1 kg/min) and producing fine-grade paper with a basis weight of 80 g/m$^2$.

The pulp constituents in the pilot-scale test machine run were as follows: birch/pine pulp mixed in ratio 75/25 and beaten to a freeness of 25° SR. The filler was precipitated calcium carbonate (PCC) by 22% of paper weight. The internal size starch was Raisamyl 135 (Raisio Chemicals) by 0.5% of fiber weight and the retention agents were used by a 0.22% overall amount of fiber weight.

The internal sizes were dosed into the pulp slurry by 0.15 and 0.20% of fiber weight. The surface size was Raisio Chemicals' Raisamyl 408 SP surface size starch, and it was used in a consistency of 8% on dry weight basis.

The hydrophobicity of the sheet manufactured in the pilot-scale paper machine was tested by the Cobb$_{60}$ water absorption test using samples taken immediately from the Pope winder and conditioned for 10 min before the test. Additionally, the hydrophobicity of the sheet made in the pilot-scale machine was tested using roll-cured samples in both the Cobb$_{60}$ absorption test and the HST ink penetration test. The HST test is based on the penetration of ink into the sheet, monitored from the reflectance of an ink spot in a given time, e.g., the time during which the reflectance falls to 80% of its initial value. The compatibility of the paper samples with ink-jet printing were tested using a commercial-grade ink-jet printer (manufactured by Hewlett-Packard). The wicking and bleeding qualities of the printing result were evaluated from the printed test sheets both visually and using an image analysis facility and by measuring the optical densities of the printed color areas.

TABLE 2

| Size composition/dosing [%] | Cobb$_{60}$ test [g/m$^2$] immediately after 10 min aeration | after curing in a roll | HST test [s] after curing in a roll |
|---|---|---|---|
| palmitic/stearic acid ratio 60/40 | | | |
| 0.13 | 50.3 | 41.9 | 38 |
| 0.20 | 23.2 | 19.3 | 345 |
| palmitic/stearic acid ratio 40/60 | | | |
| 0.13 | 52.0 | 43.3 | 27 |
| 0.20 | 19.9 | 18.9 | 385 |
| isostearic-acid-based AKD size, 100% branched chains | | | |
| 0.13 | 57.7 | 48.1 | 12 |
| 0.20 | 39.9 | 33.3 | 54 |
| isostearic-acid-based AKD size, 50/50 branched/ unbranched chains | | | |
| 0.13 | 51.5 | 42.6 | 33 |
| 0.20 | 20.2 | 19.2 | 355 |

TABLE 2-continued

| Size composition/-dosing [%] | Cobb$_{60}$ test [g/m$^2$] immediately after 10 min aeration | Cobb$_{60}$ test [g/m$^2$] after curing in a roll | HST test [s] after curing in a roll |
|---|---|---|---|
| isostearic-acid-based AKD size, 40/60 branched/unbranched | | | |
| 0.13 | 52.3 | 42.8 | 25 |
| 0.2 | 20.1 | 19.4 | 360 |
| isostearic-based-AKD size, 60/40 branched/unbranched | | | |
| 0.13 | 53.4 | 44.6 | 28 |
| 0.2 | 20.2 | 20.1 | 298 |

As is evident from the results given in Table 2, the isostearic-acid-based AKD size (with a ratio of 40/60 to 60/40 of branched/non-branched carbon chains) achieves a hydrophobicity quality comparable with that available by conventional AKD sizes.

TABLE 3

| | palmitic/stearic acid ratio 60/40 Dosing 0.20% | palmitic/stearic acid ratio 40/60 Dosing 0.20% | isostearic-acid-based AKD size, 100% branched chains Dosing 0.20% | isostearic-acid based AKD size, 50/50 branched/non-branched chains Dosing 0.20% | isostearic-acid based AKD size, 40/60 branched/unbranched Dosage, 0.20% | isostearic-acid based AKD. 60/40 branched/unbranched Dosage, 0.20% |
|---|---|---|---|---|---|---|
| Ink-jet printing, black-and-white drying time | 7 | 8 | immediate | 6 | 6 | 6 |
| wicking density | 6.5 | 6.3 | 10 | 5.5 | 6 | 5.7 |
| | 1.38 | 1.44 | 1.1 | 1.42 | 1.42 | 1.42 |
| Full-colour printing bleeding | 7.4 | 7.5 | 6.5 | 6.5 | 6.5 | 6.5 |
| print area | 50749 | 51850 | 49595 | 48440 | 49447 | 48590 |
| print perimeter | 2045 | 2016 | 1949 | 1905 | 1940 | 1934 |
| density, black | 1.24 | 1.28 | 0.98 | 1.27 | 1.27 | 1.22 |
| Surface size consumption [l/min] | 1.51 | 1.43 | 1.60 | 1.33 | 1.33 | 1.44 |

As is evident from the results given in Table 3, the isostearic-acid-based AKD size (with a ratio of 40/60 to 60/40 of branched/non-branched carbon chains) in black-and-white printing achieves an optimal balance between the parameters characterizing the raggedness of the printed contour (test pattern bleeding, wicking, area and perimeter) and size consumption. Moreover, it must be noted that the surface sizing according to the present invention is performed without using conventional hydrophobizing agents or other surface-hydrophobizing techniques.

EXAMPLE 3

An internal size according to the invention, particularly the isostearic-acid-based AKD size with a 50/50 ratio of branched-to-non-branched carbon chains that was found to perform best in the laboratory- and pilot-scale tests, was further tested in a paper machine making fine-grade paper in an industrial scale. The comparative samples of the test were made using a conventional AKD size. The composition of the manufactured paper was equivalent to a typical fine-grade paper containing precipitated calcium carbonate (PCC), thus being suitable for use in ink-jet printing. The basis weight of the paper made in the test run was 70 g/m$^2$. The amount of added size of 1.3 kg/ton of paper.

Sheet samples taken from a number of machine rolls produced during the test run were analyzed from their top sides for hydrophobicity (Cobb$_{60}$ and HST) and parameters (wicking, bleeding and optical densities) characterizing compatibility with ink-jet printing.

TABLE 4

| Sizing/measured parameter | Isostearic-acid-based AKD size, 50/50 branched/non-branched carbon chains | Commercial-grade AKD size with a palmitic/stearic acid ratio of 40/60 |
|---|---|---|
| Cobb$_{60}$ test [g/m$^2$] | 22.2 | 28.8 |

TABLE 4-continued

| Sizing/measured parameter | Isostearic-acid-based AKD size, 50/50 branched/non-branched carbon chains | Commercial-grade AKD size with a palmitic/stearic acid ratio of 40/60 |
|---|---|---|
| HST test [s], surface | 86.5 | 54 |
| Ink-jet printing | | |
| wicking on surface | 3 | 4 |
| bleeding on surface | 2 | 2 |

TABLE 4-continued

| Sizing/measured parameter | Isostearic-acid-based AKD size, 50/50 branched/non-branched carbon chains | Commercial-grade AKD size with a palmitic/stearic acid ratio of 40/60 |
|---|---|---|
| Ink-jet printing | | |
| black | 1.84 | 1.4 |
| black, combined | 1.10 | 1.13 |
| cyan | 1.37 | 1.36 |
| magenta | 0.93 | 0.92 |
| yellow | 0.91 | 0.88 |

From the ink-jet printing compatibility comparison of a sheet sized using an isostearic-acid-based AKD size with a sheet sized with a commercially available AKD size (according to results given in Table 4), it is evident that the isostearic-acid-based AKD size gives a clearly better printing result with both black ink and color inks. Paper sized with an isostearic-acid-based size exhibited no penetration of ink through the sheet nor any wicking or bleeding. Moreover, the density of the printed inks was essentially better than on paper samples sized with a commercial-grade AKD size. Furthermore, it must be noted that the high-quality printability of the sheet was attained without any need for sheet surface hydrophobizing.

Finally, on the basis of full-scale production tests, it was proved that the paper manufactured in a test run on a paper machine was not only suitable for ink-jet printing, but also could meet other requirements set for a "multi-purpose" paper such a sufficient degree of hydrophobicity for copier and laser printer output. During the test, the runnability of the paper machine was excellent and no dirt adherence or contamination was found on the surfaces of the paper machine components.

EXAMPLE 4

In this example a paper grade was surface treated, for which paper already a certain degree of hydrophobicity was developed by internal sizing of the paper in the slurry stage of its manufacture. The hydrophizing effect was on the level of 30 g/m$^2$ according to Cobb$_{60}$. The surface sizing of the paper was effected using a Helicor-device, where the paper sheet to be treated lays on a rotatable drum, and where a surface sizing starch together with a incorporated surface hydrophobizing agent can be applied using a selected blade pressure.

The surface sizing starch used in this example was an oxidated cationic surface starch as a 10% solution (Raisamyl 406 SP, Raisio Chemicals Oy). This starch solution with a 10% consistency was admixed with surface size additives in different amounts calculated on the basis of the active agent on the starch dry matter. As surface size additive was tested isostearic/stearic acid AKD, styrene acrylate and SMA surface size additives. Isostearic-stearic acid (i.e. branched-non-branched chain) relation in the AKD size was 1:1. As styrene acrylate was used the size Raisafob P400 (Raisio Chemicals Oy). The SMA used was styrene maleic anhydride, fabricated by Raisio Chemicals and marketed under the name Raisafob D100.

The test results are given in the following table 5, where the sizing results are given in Cobb$_{60}$ and HST-values.

TABLE 5

| Surface size additive | Additive amount, % of surface size | Cobb$_{60}$, g/m$^2$ | HST (80%), s |
|---|---|---|---|
| Paper furnish | 0 | 30,4 | 67 |
| Furnish + surface size starch | 0 | 46,6 | 60 |
| Isostearic/stearic-AKD | 0.5 | 22.4 | 126 |
| | 1 | 22.4 | 137 |
| | 2 | 20.4 | 140 |
| | 4 | 20.0 | 182 |
| Styrene acrylate | 1 | 41.6 | 65 |
| | 2 | 39.2 | 69 |
| | 4 | 36.0 | 78 |
| SMA | 1 | 38.4 | 75 |
| | 2 | 29.2 | 115 |
| | 4 | 21.6 | 117 |

The values in table 5 indicate, that the AKD size made from fatty acids containing isostearic acid shows the best properties already on the lowest addition amounts used, and gives the highest hydrophobicity according to both Cobb$_{60}$ and HST test values.

The test results used for the evaluation of the black and white printability are given in the following table 6. The paper probes were printed using a ink-jet printer of the type of Hewlett-Packard 500 C, and the optical densities of the prints were measured.

TABLE 6 ink-jet printing results, HP 560 C printer

| Surface size additive | Additive amount, % of the surface starch | Black-white print: Black density | Colour print Combi-black density |
|---|---|---|---|
| Paper furnish | 0 | 1.33 | 0,98 |
| Furnish + surface starch | 0 | 1.58 | 1.26 |
| Isostearic/-stearic AKD | 0,5 | 1.67 | 1.19 |
| | 1 | 1.76 | 1.22 |
| | 2 | 1.85 | 1.31 |
| | 4 | 1.86 | 1.32 |
| Styrene acrylate | 1 | 1.58 | 1.23 |
| | 2 | 1.60 | 1.25 |
| | 4 | 1.67 | 1.25 |
| SMA | 1 | 1.74 | 1.27 |
| | 2 | 1.75 | 1.31 |
| | 4 | 1.80 | 1.30 |

The results in table 6 show, that the black and white printing gives even better printability results than the common compounds used in the surface sizing of paper.

EXAMPLE 5

The surface size additives were tested also on a pilot paper machine, where a paper grade having no preliminary surface sizing was sized using a pond size press and a film size press. The paper furnish consisted of a fine paper grade with the grammage of 80 g/m$^2$, and it contained 20% of precipitated calcium carbonate as filler of the paper furnish (a common multipurpose office paper). The surface size used was oxidated cationic surface size (Raisamyl 405 SP, Raisio Chemicals Oy) as a 8% consistency solution. The surface size starch was admixed with different hydrophobizing surface size additives: elementary AKD (palmitic/stearic acid, 60/40%), isostearic-stearic acid AKD (branched/non-branched, 50/50%), styrene-acrylate (Raisafob P400, Raisio Chemicals Oy) and SMA based (styrene maleic anhydride, Raisafob D100, Raisio Chemicals Oy) surface size additives.

The following table 7 contains the test results received on a pilot paper machine, where a film size press was used.

TABLE 7

Sizing results using a film size press on a pilot paper machine

| Surface size additive | Amount of the additive, % of the surface starch | $Cobb_{60}$, $g/m^2$ | HST (80%), s |
|---|---|---|---|
| Furnish + surface size starch | 0 | 42.3 | 143 |
| Elementary AKD | 0.25 | 25.6 | 255 |
| | 0.50 | 23.8 | 273 |
| | 1 | 20.3 | 310 |
| | 2 | 19.2 | 380 |
| Isostearic/ stearic AKD | 0.25 | 27.8 | 247 |
| | 0.50 | 25.7 | 251 |
| | 1 | 22.3 | 239 |
| | 2 | 20.4 | 285 |
| Styrene acrylate | 2 | 30.8 | 223 |
| | 4 | 25.6 | 229 |
| SMA | 2 | 25.3 | 266 |
| | 4 | 21.1 | 282 |

The following table 8 contains results received on ink-jet printing of paper probes, where a HP 560 C printer was used in the printing. The print results were analyzed according to a dry evaluation method.

TABLE 8

Black and white printability in a HP 560 C printer

| Surface size additive | Black and white print | | | Colour print | | |
|---|---|---|---|---|---|---|
| | Density | Wicking | Drying time | Density | Bleeding: area | Bleeding: perimeter |
| Furnish + surface size | 1.07 | 2.1 | 1 | 0.95 | 49057 | 1834 |
| Elementary AKD 0.5 % | 1.19 | 1.6 | 16 | 0.97 | 51103 | 2019 |
| Elementary AKD 1.0 % | 1.22 | 1.5 | 24 | 0.98 | 49152 | 1923 |
| Isostearic/ stearic AKD 0.50% | 1.18 | 1.6 | 7 | 0.97 | 48313 | 1913 |
| Isostearic/ stearic AKD 1.0 % | 1.21 | 1.5 | 13 | 0.98 | 47609 | 1898 |
| Styrene acrylate 1.0 % | 1.14 | 1.8 | 2 | 0.95 | 47654 | 1847 |
| Styrene acrylate 2.0 % | 1.14 | 1.7 | 4 | 0.96 | 47966 | 1821 |
| SMA 1.0 % | 1.20 | 1.6 | 17 | 0.96 | 47058 | 1808 |
| SMA 2.0 % | 1.23 | 1.5 | 26 | 0.97 | 47099 | 1909 |

The figures appearing in the tables 7 and 8 indicate, that the elementary AKD has given very good hydrophobicity results in the evaluated probes. The high hydrophobicity can, however, lead to a too low drying of the colors with a resulting unevenness in color on color printing. These results seem to indicate, that the best balance in the size consumption, the black and white printing and the color printing can be achieved using the isostearic/stearic acid AKD, which is consisting from branched and non-branched carbon chains.

What is claimed is:

1. A method of manufacturing a paper of mono- and multi-color ink-jet printable grade by de-watering a paper web from fiber pulp slurry, said method containing a step of adding a 2-oxetanone based size to said pulp slurry, said 2-oxetanone being manufactured from a plurality of saturated fatty acids having a main chain comprising 6 to 22 carbons essentially free of unsaturated bonds, wherein at least one said fatty acid comprises a branched chain.

2. The method of claim 1, wherein said 2-oxetanone size is made from a mixture of saturated linear-chain and saturated branched-chain fatty acids.

3. The method of claim 1, wherein said 2-oxetanone size is made from a mixture of saturated fatty acids with the proportion of linear-chain and branched-chain fatty acids in the order of 1 to 1.

4. The method of claim 1, wherein the 2-oxetanone size is made from a mixture of fatty acids wherein said at least one branched-chain fatty acid comprises at least 40% of said mixture.

5. The method of claim 1, wherein said at least one branched-chain fatty acid is isostearic acid.

6. The method of claim 1, wherein the 2-oxetanone size is added in an amount of from 0.05% to 0.25% of fiber weight in the pulp slurry.

7. The method of claim 1 including further a step of adding a hydrophobizing size onto the de-watered web.

8. The method of claim 1 including further a step of adding a mineral filler material to the slurry.

9. The method of claim 8, wherein the filler material is calcium carbonate.

10. The method of claim 8, wherein the filler material is precipitated calcium carbonate.

11. The method of claim 1 conducted under neutral conditions.

12. The method of claim 1 conducted under alkaline conditions.

13. A paper grade made using the method of claim 1.

14. A method of manufacturing a paper of mono- and multi-color ink-jet printable grade from fiber pulp slurry into a paper web, the method containing a step of adding a size onto the paper web, wherein the size is a 2-oxetanone based size manufactured from a plurality of saturated fatty acids having a main chain comprising 6 to 22 carbons essentially free of unsaturated bonds, and wherein at least one said fatty acid comprises a branched chain.

15. The method of claim 14, wherein said 2-oxetanone is made from a mixture of a linear-chain and a branched-chain fatty acids.

16. The method of claim 14, wherein the 2-oxetanone size is made from a mixture of fatty acids with the proportion of linear-chain and branched-chain fatty acids in the order of 1 to 1.

17. The method of claim 14, wherein the 2-oxetanone size is made from a mixture of fatty acids with a fatty acid proportion of 40% or higher of the at least one branched-chain fatty acid.

18. The method of claim 14, wherein the at least one branched-chain fatty acid is isostearic acid.

19. The method of claim 14, wherein the 2-oxetanone size is added in an amount of from 0.05% to 0.25% of the fiber weight in the pulp slurry.

20. The method of claim 14, including further a stock sizing step where a 2-oxetanone based stock size is used which is manufactured from greater number than one of fatty acids, the acids having a main chain comprising 6 to 22 carbons linked to each other by saturated bonds, and of which acids at least one is an acid with a branched chain.

21. The method of claim 14 further including a step of adding a filler material into the pulp slurry.

22. The method of claim 21, wherein the filler material is calcium carbonate.

23. The method of claim 21, wherein the filler material is precipitated calcium carbonate.

24. The method of claim 14 conducted under neutral conditions.

25. The method of claim 14 conducted under alkaline conditions.

26. A paper grade made using the method of claim 14.

27. A 2-oxetanone based paper size manufactured from fatty acids having a main chain containing 6–22 carbons free of unsaturated bonds, and at least 40% of the chains including a branching.

28. A 2-oxetanone based paper size of claim 27 wherein 40 to 60% of said fatty acids have a branched main chain.

29. A 2-oxetanone based paper size of claim 27 wherein said fatty acid with the branched main chain is isostearic acid.

* * * * *